US005238098A

United States Patent [19]

Mori

[11] Patent Number: 5,238,098

[45] Date of Patent: Aug. 24, 1993

[54] PREPARATION METHOD AND PREPARATION MECHANISM OF WEFT PACKAGES

[75] Inventor: Kiyoaki Mori, Ishikawa, Japan

[73] Assignee: Tsudakoma Kogyo Kabushiki Kaisha, Ishikawa, Japan

[21] Appl. No.: 838,044

[22] Filed: Feb. 19, 1992

[30] Foreign Application Priority Data

Feb. 21, 1991 [JP] Japan ..... 3-111239
Apr. 2, 1991 [JP] Japan ..... 3-94933

[51] Int. Cl.[5] ..... B65G 37/00
[52] U.S. Cl. ..... 198/358; 198/418.1
[58] Field of Search ..... 198/418, 418.1, 418.2, 198/358, 359, 465.1, 465.3, 431, 463.4, 368

[56] References Cited

U.S. PATENT DOCUMENTS

| | | | |
|---|---|---|---|
| 3,191,357 | 6/1965 | Hawley et al. | 198/418.2 X |
| 4,385,859 | 5/1983 | Goossens | 198/418.1 X |
| 4,561,060 | 12/1985 | Hemond | 198/358 X |
| 4,564,102 | 1/1986 | Mori et al. | 198/358 X |
| 4,832,176 | 5/1989 | Okuma et al. | 198/418.1 |
| 4,949,833 | 8/1990 | Sakamoto | 198/358 |

FOREIGN PATENT DOCUMENTS

| | | |
|---|---|---|
| 0459553A1 | 12/1991 | European Pat. Off. . |
| 2402744 | 8/1974 | Fed. Rep. of Germany . |
| 3912488 | 10/1990 | Fed. Rep. of Germany . |
| 1-317965 | 3/1990 | Japan . |
| WO90/11956 | 10/1990 | PCT Int'l Appl. . |

*Primary Examiner*—Robert P. Olszewski
*Assistant Examiner*—James R. Bidwell
*Attorney, Agent, or Firm*—Graybeal Jackson Haley & Johnson

[57] ABSTRACT

Full weft package transfer mechanism for weaving machines including delivery devices at a loading location which are positionable in a vertical position or an inclined position in alignment with and below an inclined guide with each full weft package being held on a tray, the delivering devices including a holding plate having a concave portion accepting the part of the weft package tray projecting below the guide to effect delivery of the weft package to the delivery devices which is then positioned in a vertical position for movement of the weft package to the weaving machines' installation region.

2 Claims, 17 Drawing Sheets

FIG. 18

| MACHINE NO. | STAND NO. | KIND OF THREAD |
|---|---|---|
| 1 | 1<br>2 | a<br>b |
| 2 | 1<br>2 | a<br>b |
| 3 | 1<br>2 | a<br>b |
| 4 | 1<br>2 | b<br>c |
| 5 | 1<br>2 | b<br>c |
| 6 | 1<br>2 | b<br>c |

FIG. 19

| STAND NO. | KIND OF THREAD |
|---|---|
| 1<br>2 | a<br>b |
| 3<br>4 | a<br>b |
| 5<br>6 | a<br>b |
| 7<br>8 | b<br>c |
| 9<br>10 | b<br>c |
| 11<br>12 | b<br>c |

PREPARATION METHOD AND PREPARATION MECHANISM OF WEFT PACKAGES

BACKGROUND OF THE INVENTION

1. Field of the Invention

This invention relates to a preparation method and a preparation mechanism for supplying full weft packages to carriers used for supplying them to weaving machines and for recovering empty weft packages from the weaving machines, and also relates to an accommodation method and an accommodation device for accepting the empty packages from the carriers.

2. Description of the Prior Art

As disclosed in Japanese Patent Disclosure (KOKAI) No. 1-317965, supply of full weft packages to weaving machines and recovery of empty weft packages from the weaving machines have been mechanically done using carriers travelling the installation region of the weaving machines, the supply region of the full packages and the accommodation region of the empty packages.

However, the supply of the full packages to the weaving machines or the recovery of the empty packages from the weaving machines by using the carriers is made only with respect to a single kind of thread, that is, with respect to the same kind of wefts in their colors and materials, and no consideration is taken to a plurality of kinds of threads.

SUMMARY OF THE INVENTION

An object of the present invention is to provide a method and an apparatus for preparing for supplying full weft packages with different kinds of threads to carriers or for accepting empty packages recovered to the carriers from weaving machines when the above-mentioned full packages are supplied to the weaving machines.

A preparation method of weft packages in accordance with the present invention includes the step of selectively disposing one of a plurality of full packages having a plurality of kinds of threads in the neighborhood of a point in the supply region of the full packages on the travel path of a carrier travelling the installation region of weaving machines and the supply region of the full packages so as to feed the full packages to the carriers.

According to the present invention, a full package having an arbitrary kind of thread can be selected among full packages having a plurality of kinds of threads in response to the needs of a weaving machine, the selected full package can be disposed at one point on the travel path of the carrier, for example, in the neighborhood of a stop position of the carriers. Thus, the preparation for supplying a selected full package can be made prior to its loading to one of the carriers.

According to another embodiment of the present invention, each kind of full package may be disposed in the neighborhood of each of points on the travel path, respectively.

In addition, the travel path is constructed so as to be composed of a plurality of bypasses in the supply region, and each kind of full package may be disposed in the neighborhood of one point on each bypass.

A preparation mechanism of full packages in accordance with the present invention comprises an arrangement device for selectively disposing one of a plurality kinds of full packages in the neighborhood of a point in the supply region of the full packages on the travel path of a carrier travelling the installation region of weaving machines and the supply region of the full package so as to feed the full packages to the carriers.

According to the present invention, a full package having a kind of thread fit for the needs of a weaving machine can be disposed in the neighborhood of one point on the travel path of the carrier by operating the arrangement device on the basis of signals from the weaving machine.

The arrangement device can be composed of delivery means of the full packages provided in the neighborhood of the above-mentioned one point, a plurality of transfer means for carrying the full packages per kind of thread, and guide means for guiding the full packages from each transfer means to the delivery means.

According to this structure, the full packages having the different kinds of threads can be guided to the delivery means of the full packages through each transfer means and the guide means. Thus, the carrier can arbitrarily accept one of the full packages having a plurality of kinds of threads in the neighborhood of a disposal position of the delivery means.

Furthermore, the arrangement device can be constructed by delivery means of the full packages movable between the neighborhood of the above-mentioned one point and a plurality of other points except the above-mentioned one point, a plurality of transfer means for carrying the full packages per kind of thread, and guide means for guiding the full packages from each transfer means to the delivery means at each of other points.

According to this structure, the delivery means carries the full package having the arbitrary kinds of threads from each transfer means of the full packages having a plurality of kinds of threads to the neighborhood of one point on the travel path of the carrier, the carrier stops at one point on the travel path and can accept an arbitrary one of the full packages having a plurality of kinds of threads from the delivery means.

The arrangement device can be provided in the neighborhood of a plurality of points on the travel path, respectively.

In addition, the travel path is arranged so as to have a plurality of bypasses in the supply region, and the arrangement device can be provided in the neighborhood of one point on each bypass.

An accommodation method of empty packages in accordance with the present invention comprises the steps of accepting a plurality of empty packages corresponding to a plurality of kinds of threads from carriers, which travel the installation region of weaving machines and the accommodation region of the empty packages so as to carry the empty packages recovered from the weaving machines, in the neighborhood of one point in the accommodation region of the empty packages on the travel path of the carrier, and distributing the empty packages per kind of thread.

According to the another embodiment of the present invention, the carriers can be stopped at one point on the travel path, and the empty packages recovered by the carriers can be disposed in the accommodation region every kind of thread, that is, every size and shape in accordance with each kind of thread.

An accommodation device of the empty packages in accordance with the present invention comprises delivery means for delivering a plurality of empty packages corresponding to a plurality of kinds of threads disposed in the neighborhood of one point in the accommodation region of the empty packages on the travel path of carriers, which travel the installation region of weaving machines and the accommodation region of the empty packages so as to carry the empty package recovered from the weaving machines, and a plurality of transfer means for carrying the empty packages from the delivery means per kind of thread.

According to the present invention, since the empty packages, namely, bobbins, which are cores of the full packages having the different kinds of threads, can be guided from the delivery means of the empty packages to each transfer means, the carriers stop at one point on the travel path and can transfer arbitrarily one of the empty packages having a plurality of kinds of threads to the delivery means.

BRIEF DESCRIPTION OF THE DRAWINGS

The foregoing and other objects and features of the invention will become apparent from the following description of preferred embodiments of the invention with reference to the accompanying drawings, in which:

FIG. 18 is a table of symbols with reference to weaving machines, weft package stands and the kinds of threads corresponding to each weft package stand; and FIG. 19 is a table of symbols with reference to weft package stands and the kinds of threads corresponding to each weft package stand.

DETAILED DESCRIPTION OF PREFERRED EMBODIMENTS

Figure 1:
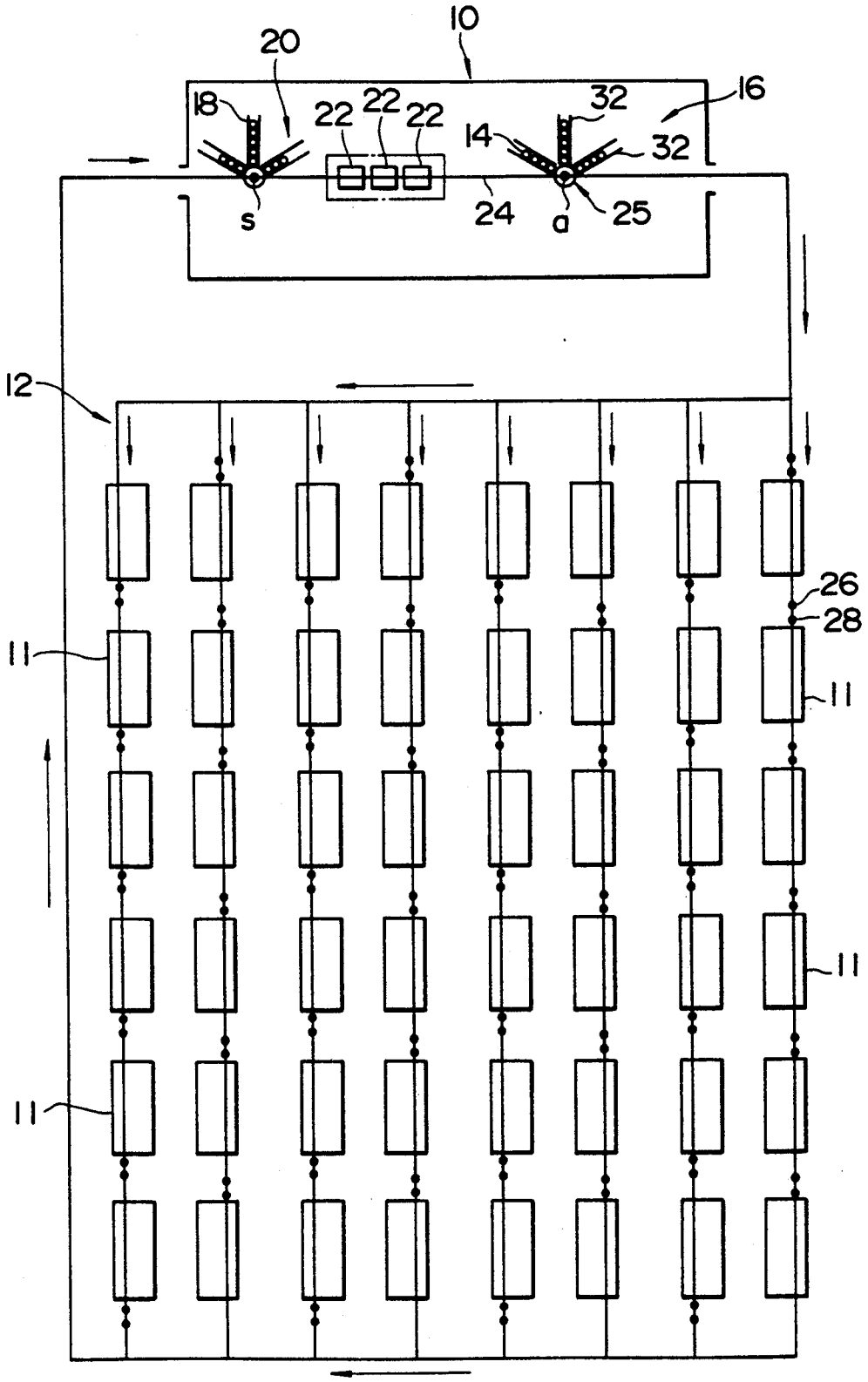
FIG. 1 is an explanatory schematic view showing a weaving factory according to the present invention.

Referring now to FIG. 1, weaving factory 10 schematically shown. Weaving factory 10 includes a region 12 equipped with a plurality of weaving machines 11, a supply region 16 of full packages 14 having wefts which differ in kinds of threads, i.e., colors and materials, an accommodation region 20 of empty packages 18 which are the cores of the full packages 14 and whose sizes and shape are different in accordance with the kind of thread, a rail or a travel path 24 for a carrier 22 travelling around the respective regions 12, 16 and 20, and a loading location 25 of the full packages 14 to one of the carriers 22 provided in the neighborhood of one point a in the supply region 16 on the travel path 24.

In the illustrated embodiment, the three kinds of full packages in weft color are ready to be used in the supply region 16, and in each weaving machine 11, two colored wefts of the three are used. A pair of weft package stands 26 and 28 for supporting the weft packages 14 of the required two colored wefts are disposed at the side of each weaving machine 11.

The carrier 22, receiving the requirements from the weaving machine 11, accepts the full package 14 having a necessary color, that is, a necessary kind of thread at the loading location 25 of the supply region 16, moves along the travel path in a direction indicated by an arrow, stops in the neighborhood of the weft package stand 26 or 28 of the weaving machine, and supplies the full package to the weft package stand in exchange with the empty packages 18 supported by either weft package stand corresponding to the necessary kind of thread. The empty package 18 recovered by the carrier 22 is then carried in a direction indicated by an arrow along the travel path 24, and accommodated in the accommodation region 20.

The illustrated carriers 22 are called as a doffer and travel along the rail travel path 24 fixed to the ceiling of the weaving factory 10. Each carrier 22 has a battery for travelling, for example, and moves either by rotating wheels by rotary motor or by a linear motor directly. When the weft packages 14, 18 are exchanged, a circuit is constructed between the carrier 22 and the weaving machine which needs the exchange of the full package 14, and a power source for the exchange operation is provided by the weaving machine.

Figure 9:
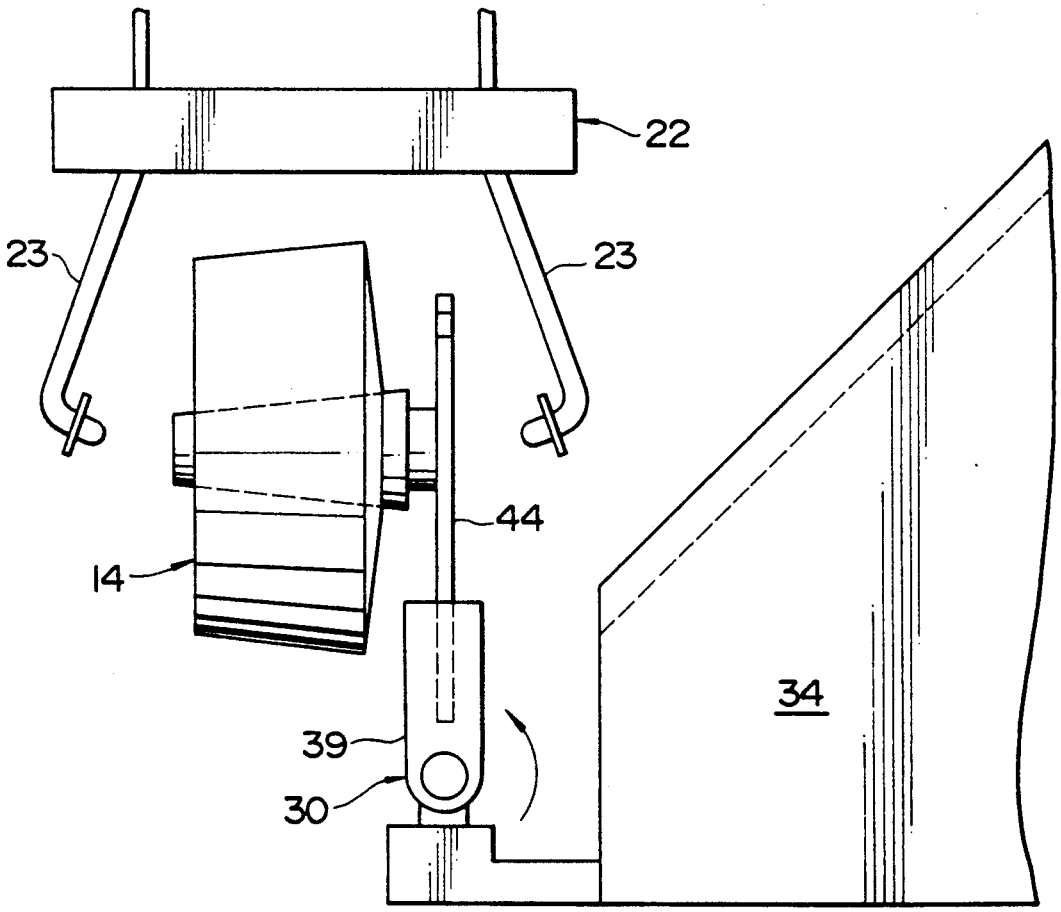
FIG. 9 is a partial enlarged-scale side view showing the arrangement device of FIG. 6 when a portion of the delivery means is in its perpendicular condition.
Figure 10:
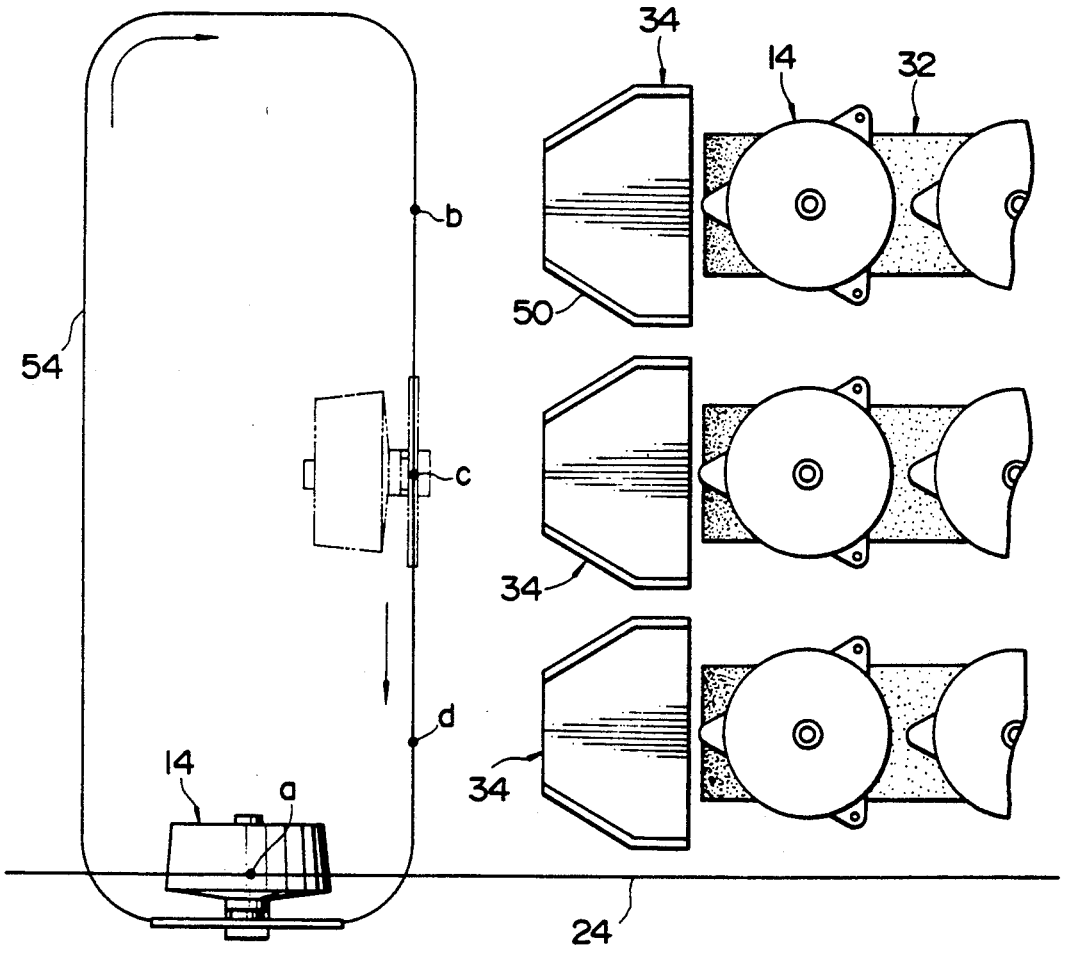
FIG. 10 is a partial schematic plan view showing a further embodiment of the arrangement device according to the present invention.
Figure 11:
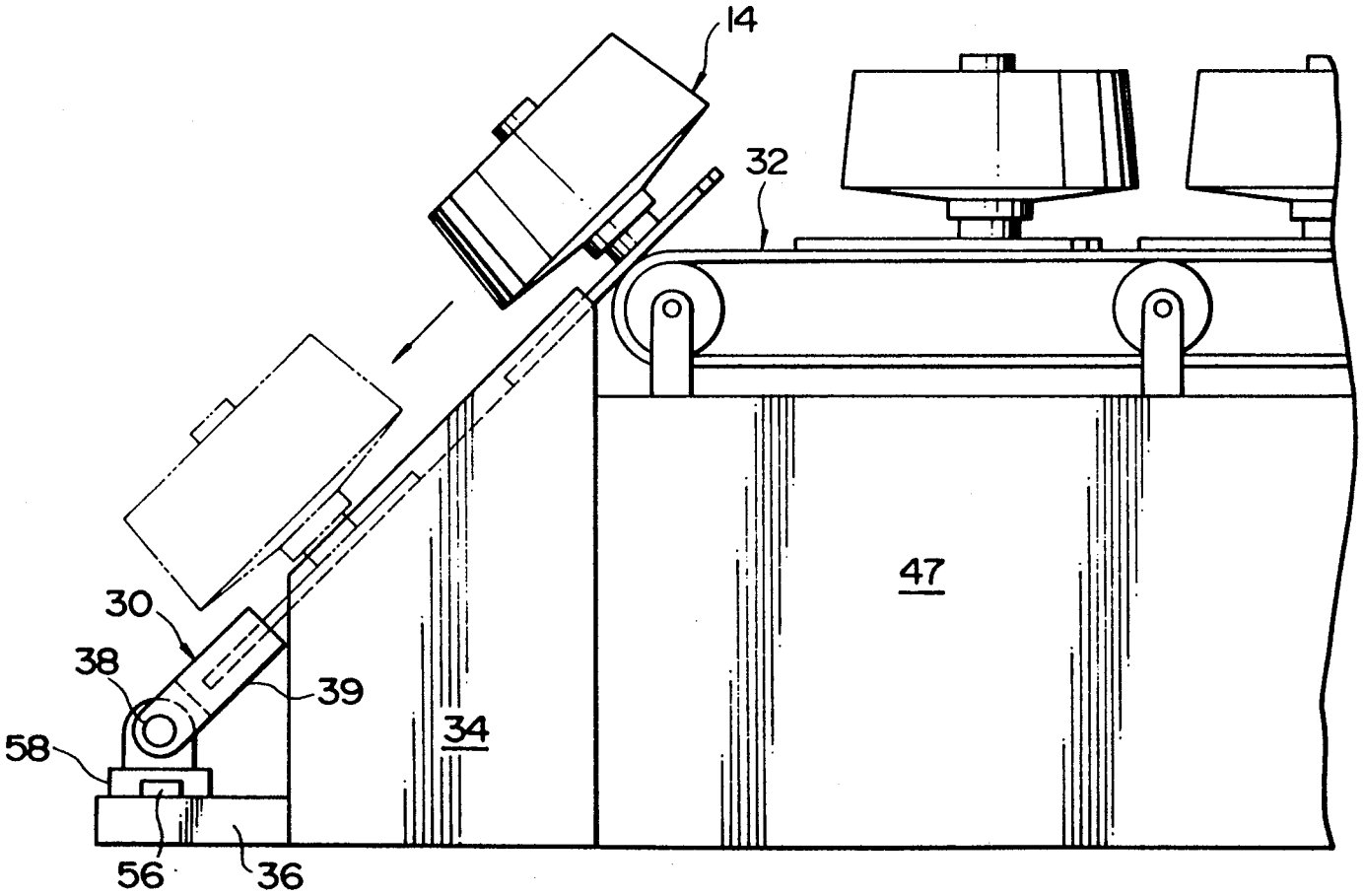
FIG. 11 is a partial enlarged-scale side view showing the arrangement device of FIG. 10 when a portion of the delivery means is in its inclined condition.
Figure 12:
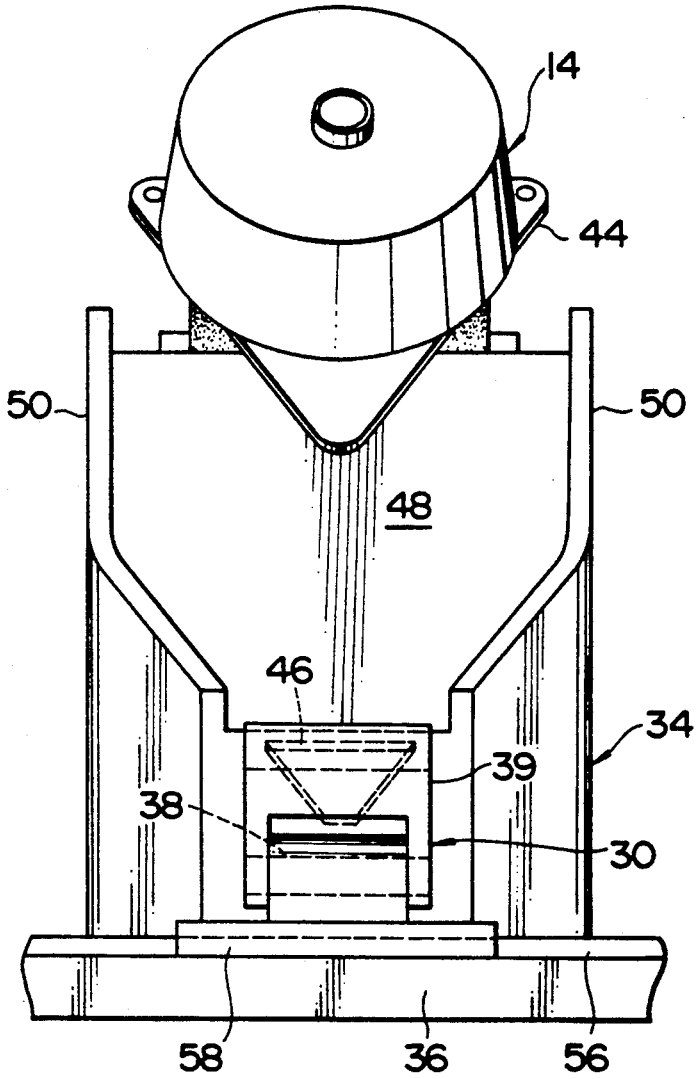
FIG. 12 is a partial enlarged-scale front view showing the arrangement device of FIG. 10 when a portion of the delivery means is in its inclined condition.
Figure 13:
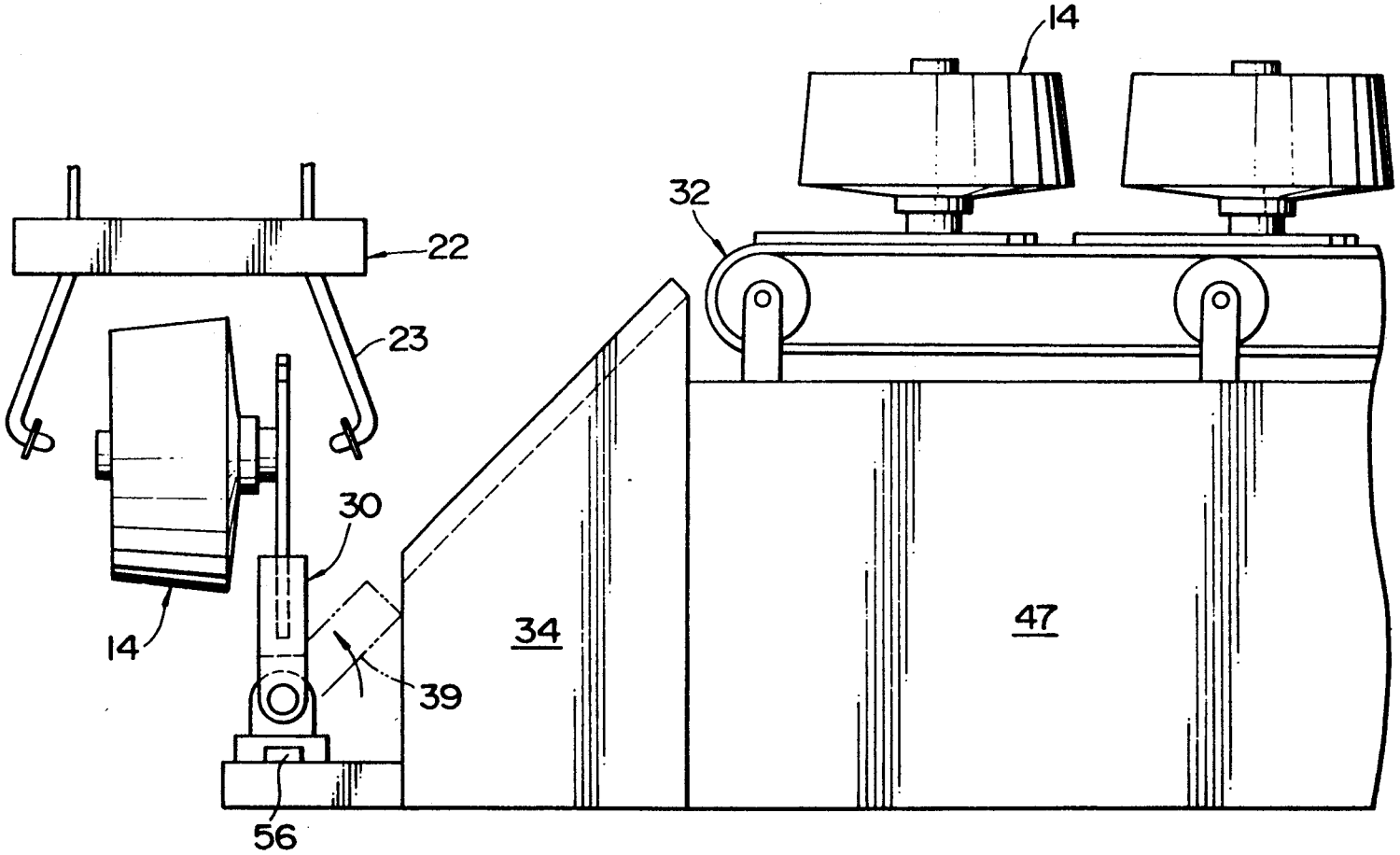
FIG. 13 is a partial enlarged-scale side view showing the arrangement device of FIG. 10 when a portion of the delivery means is in its perpendicular condition.

The loading location 25 for the full package 14 is provided on the floor surface of the weaving factory 10, that is, below the rail 24. The carrier 22 has a pair of swingable arms 23 (refer to FIG. 9), holds the full package 14 disposed at the loading location 25 with the both arms 23, and can transfer the full package 14 in a holding condition therewith.

Delivery means 30 (refer to FIGS. 2 and 3) of the full package 14 is disposed at the loading location 25 of the supply region 16 of the full package, and a plurality of transfer means 32 (three in the illustrated embodiment) for carrying the full package 14 within the supply region 16 per kind of thread and guide means 34 for guiding the full package 14 from each transfer means to the delivery means 30 are disposed at the side of the delivery means. The delivery means 30, a plurality of transfer means 32 and a plurality of guide means 34 constitute an arrangement device for selectively disposing one of the full packages 14 having a plurality of kinds of threads in the neighborhood of one point a, namely, below the rail 24 in the illustrated embodiment.

Figure 3:
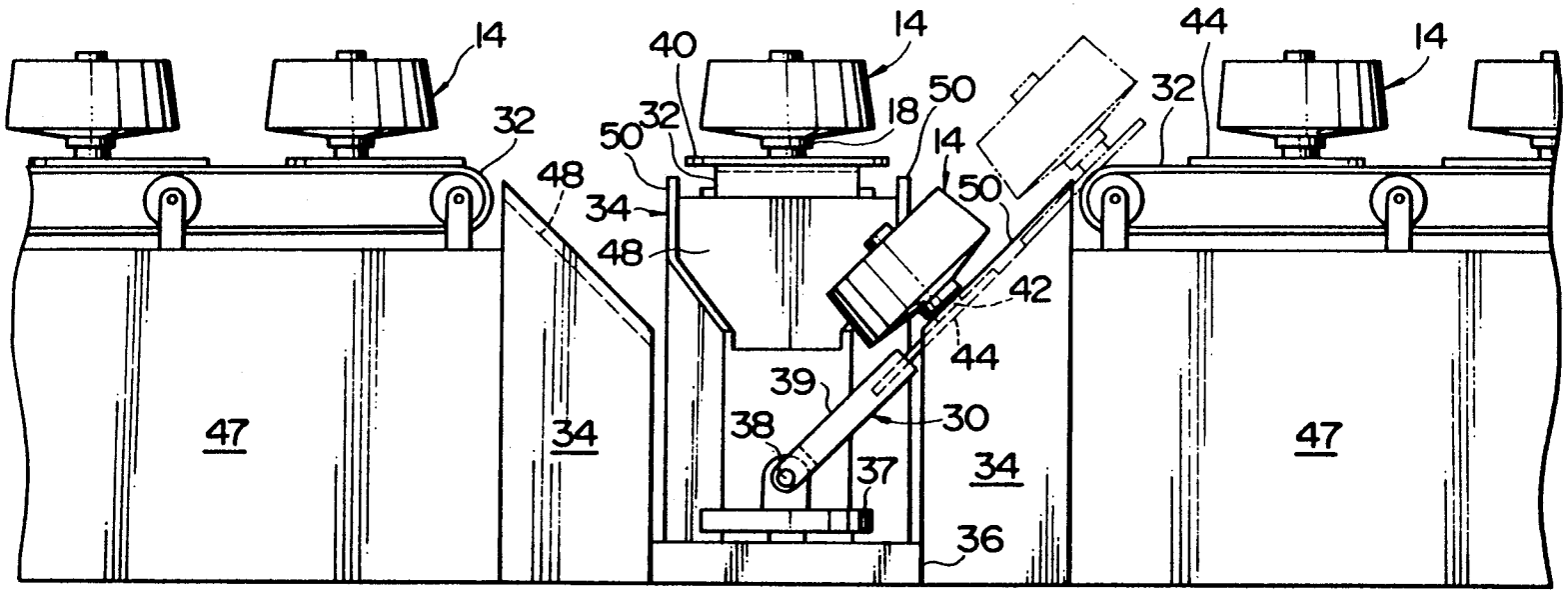
FIG. 3 is a partial enlarged-scale front view showing an arrangement device when a portion of the delivery means is in its inclined condition.

As shown in FIG. 3, the delivery means 30 for accepting the full package 14 from guide means 34 and delivering the feed body to the carrier is composed of a disc 37 rotatably provided around a vertical axis on a base 36 and a holding plate 39 supported rotatably around a horizontal axis 38 to the disc 37 and capable of maintaining perpendicular and inclined conditions.

On the other hand, a removable tray 40 is attached to the feed body 14 in order to carry the full package. The tray 40 is composed of a pipe portion 42 to be inserted into the bobbin 18 and a plate portion 44 having an approximately triangular shape in plane section and continuous perpendicular to the pipe portion 42.

The holding plate 39 has a concave potion 46 (refer to FIG. 4) which can accept one vertex portion of the triangular shape of the plate portion 44 of the tray and opened at its one end face.

Three transfer means 32 shown in the figure are composed of belt conveyers installed on a table 47, respectively and disposed in a radial direction at the intervals of 60° from one another around the delivery means 30. Three kinds of full packages 14 are loaded on three belt conveyers 32, in more detail, on these conveyer belts in the condition that the plate portion 44 of the tray is brought in contact with the conveyer belts, respectively.

Each guide means 34 disposed between each transfer means 32 and the delivery means 30 is composed of an inclined face 48 extending with an upward inclination from the delivery means 30 to the transfer means 32 with an equal angle of inclination to that in the inclined condition of the holding plate 39 of the delivery means 30 and ending at a slight interval between each transfer means 32 and the neighboring transfer means, and a pair of guide walls 50 standing up from the inclined face 48. The pair of guide walls 50 are composed of a parallel portion extending in parallel from the transfer means 32 to the delivery means 30 and a non-parallel portion ranging with the parallel portion and extending along a portion of two sides in a triangle having the same shape as the triangle of the plate portion 44 of the tray.

Therefore, a selected full package 14 is pushed out from one of the three transfer means 32 toward each guide means 34 by a transfer force thereof, and the plate portion 44 of the tray slides down on the inclined face 48 along the guide wall 50 of each guide means 34 and stops at the non-parallel portion of the guide wall 50 with a part of the plate portion projected from the non-parallel portion. A projected part of the plate portion 44 is accepted into the concave portion 46 in the holding plate 39 of the delivery means preliminarily placed in its acceptable condition (refer to FIG. 3).

Figure 4:
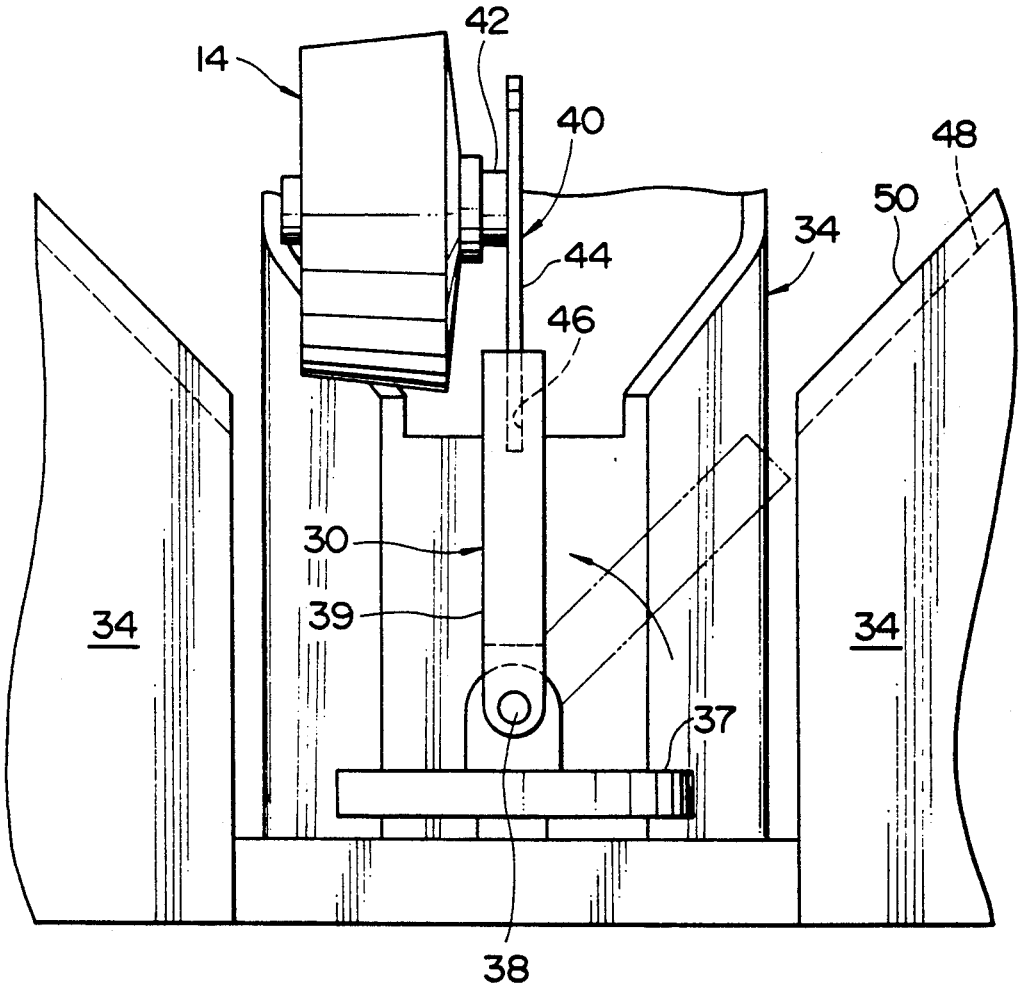
FIG. 4 is a partial enlarged-scale front view showing the arrangement device when a portion of the delivery means is in its perpendicular condition.
Figure 5:
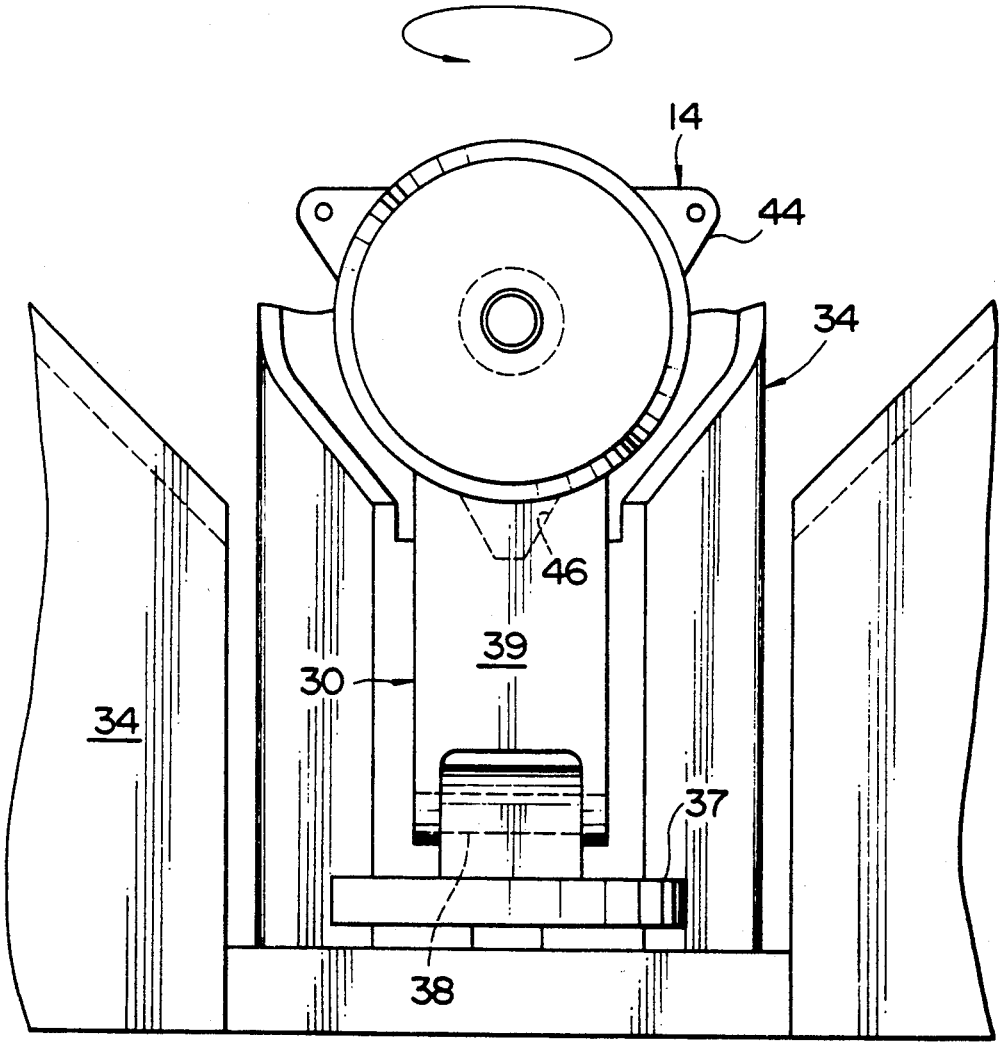
FIG. 5 is a partial enlarged-scale front view showing the arrangement device when a portion of the delivery means is in its rotated condition around a vertical axis.

Then, when the holding plate 39 is rotated around the axis 38 so as to set it in a vertical condition, the full package 14 is taken out from the guide means 34 (refer to FIG. 4). Then, the disc 37 is rotated counterclockwise, when observed as a plane, so as to set the full package 14, more exactly, the tray 40 in such an attitude as can be held by the carrier 22 (refer to FIG. 5). However, there is no need to rotate the disc 37 with respect to the full package 14 supplied from the central transfer means and the guide means in FIGS. 2 and 3, since the tray takes the above-mentioned attitude when the holding plate 39 is set in is perpendicular condition.

Thus, any one of the full package 14 having a plurality of kinds of threads can be selectively disposed in the neighborhood of one point a on the travel path 24.

As shown in FIGS. 6 through 9, the number of the guide means for guiding the full packages 14 from three transfer means 32 to the delivery means 30 may be one. This one guide means 34 has similarly the inclined face 48 and a pair of guide walls 50 as well, and the guide wall 50 has a pair of parallel portions and non-parallel portions, respectively. In this embodiment, however, the space between the parallel portions is set in such a size as to enable the full package 14 to be accepted between the parallel portions from any of the three parallel transfer means. The space at the lower end of the non-parallel portion is similar to those shown in FIGS. 2 through 5.

Figure 6:
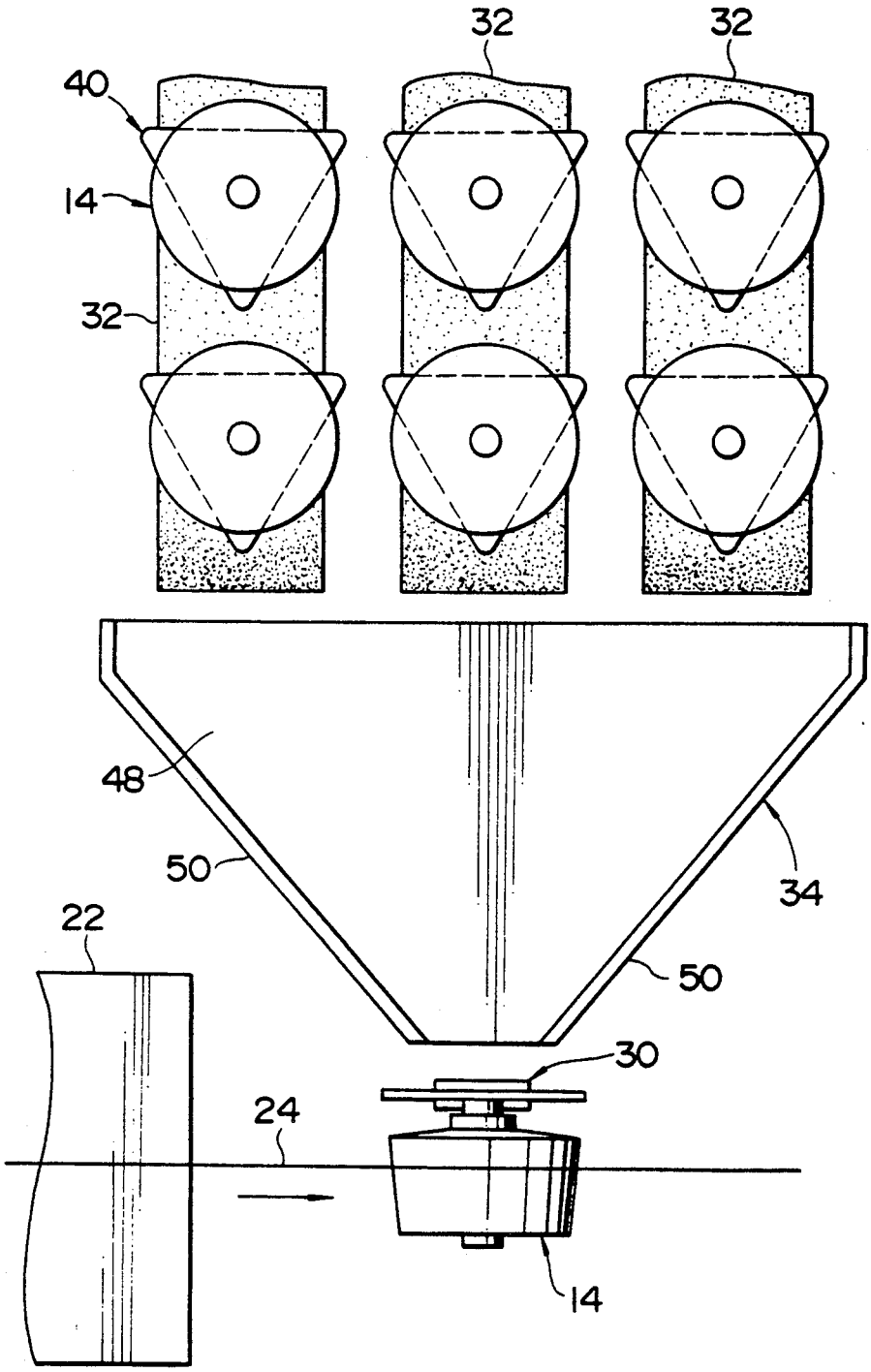
FIG. 6 is a partial schematic plan view showing another embodiment of the arrangement device according to the present invention.

In this embodiment, three transfer means 32 extend in parallel with one another in a perpendicular direction to the travel path 24 (refer to FIG. 6). According to this structure, when the full package 14 is received by the delivery means 30 and the holding plate 39 is set in its perpendicular condition, the full package 14 is brought into such attitude as can be held by the carrier. Therefore, the delivery means 30 do not have any rotatable discs rotatable around the vertical axis.

Figure 7:
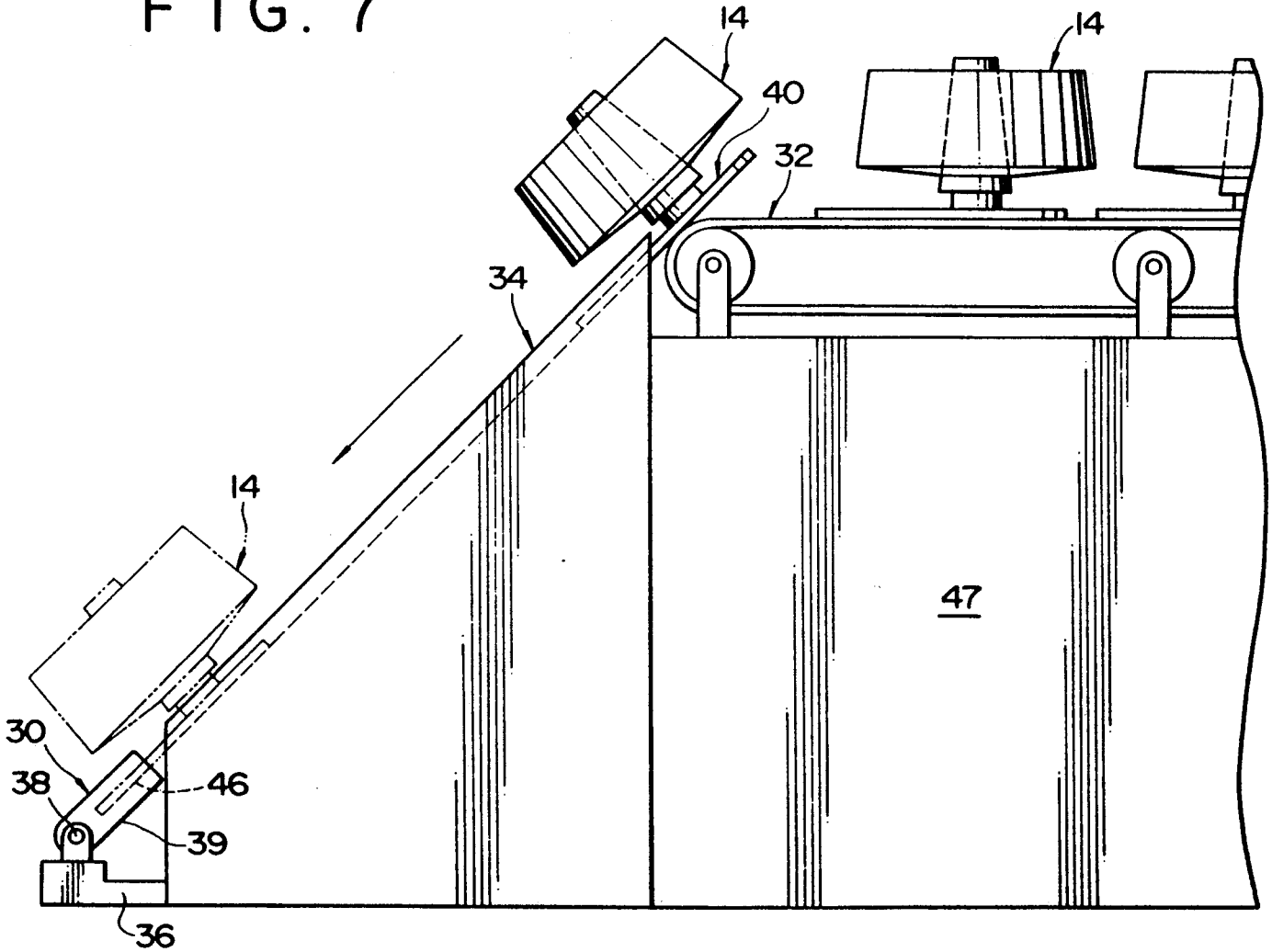
FIG. 7 is a partial enlarged-scale side view showing the arrangement device of FIG. 6 when a portion of the delivery means is in its inclined condition.
Figure 8:
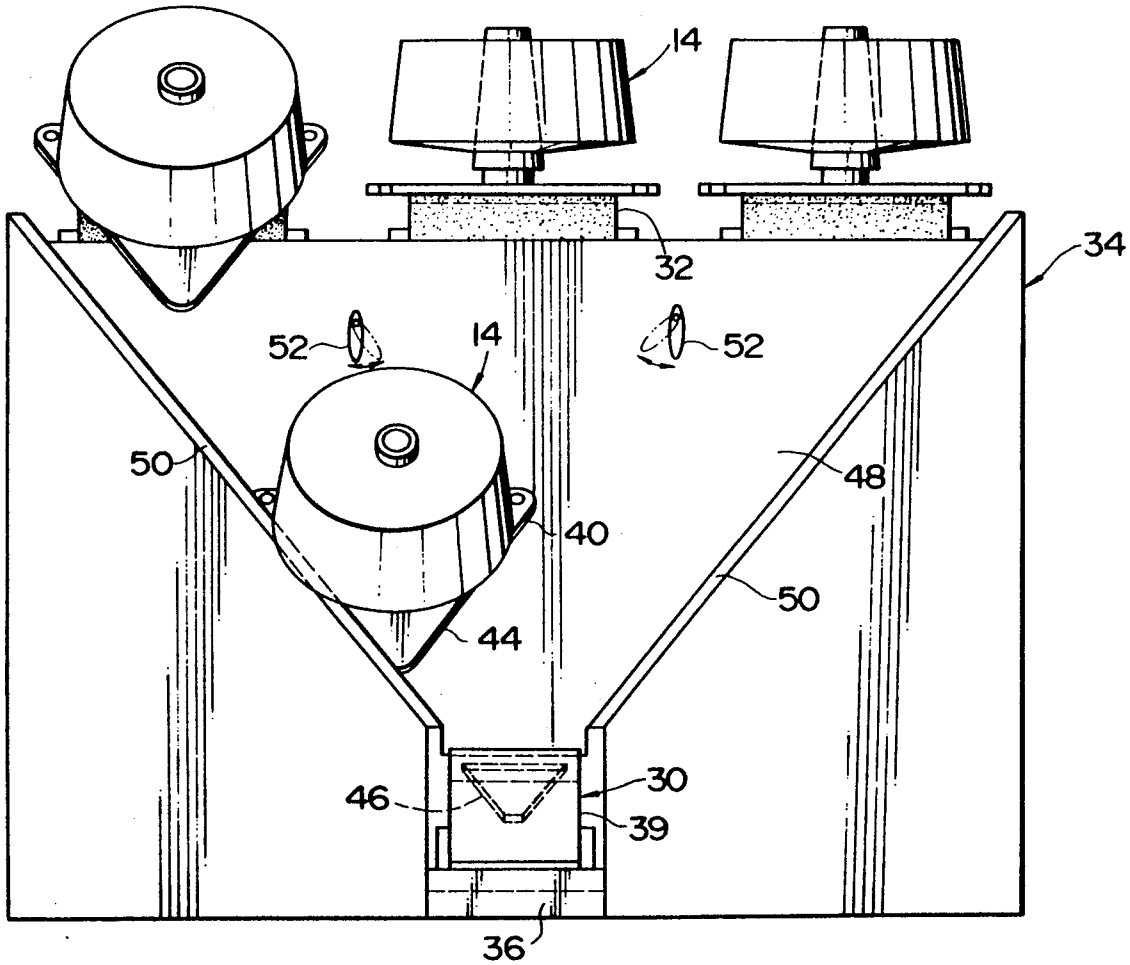
FIG. 8 is a partial enlarged-scale front view showing the arrangement device of FIG. 6 when a portion of the delivery means is in its inclined condition.

As shown in FIGS. 7 and 8, according to this guide means 34, the full package 14 supplied through the transfer means 32 at the outer two rows slide on the inclined face 48 down to the concave portion 46 of the holding plate 39 along the guide wall 50, respectively, and the full package 14 supplied through the transfer means 32 at the central row also slides on the inclined face 48 down to the concave portion 46 of the holding plate 39 by receiving the guide action of a pair of guide members 52 (only shown in FIG. 8) swingable on the inclined face 48 and provided on the inclined face 48 to be spaced apart from each other.

Referring now to FIGS. 10 through 13, three transfer means 32 are arranged on one side of a lower portion of the travel path 24 in parallel with the travel path 24, and the guide means 34 similar to those shown in FIGS. 2 through 5 are arranged on the downstream side in the transferred direction of each transfer means 32.

The difference between this embodiment and the above-mentioned two embodiments exists in the point that the delivery means 30 (refer to FIG. 11) is set to be movable between the neighborhood of one point a on the travel path 24 and a plurality of other points b, c, and d, that is, the neighborhood of the guide means 34, in more details, the inclined downward position of the guide means 34. In the illustrated embodiment, the delivery means 30 travels along a rectangular and loop-like path 54 for connecting the above-mentioned one point a to the above-mentioned other points b, c and d. Because of this travel, a rail 56 is disposed on the base 36 along the travel path 54 in the lower portion of the rail 24, and the holding plate 39 is pivotally attached to the rail 56 through a slidable slider 58.

According to the embodiment shown in FIGS. 10 through 13, the delivery means 30 is stopped in the neighborhood of any one of the above-mentioned other points b, c and d, that is, either of the guide means 34 in accordance with a required kind of thread, and accepts the full package 14 having the required kind of thread. Then, the delivery means 30 is moved in a direction indicated by an arrow up to the neighborhood of one point a on the travel path 24. Even in this embodiment, the attitudes of the full package 14 in the neighborhood of one point a on the travel path as stopping and waiting position of the carrier are under such a condition as the holding by the carrier 22 is possible. Therefore, there is no rotational motion of the full package 14 around the vertical axis.

In any of the embodiments described above, it is possible to stop each carrier 22 at one point a on the travel path 24 and to deliver any one of the full packages 14 having a plurality of kinds of threads to load on the carrier.

In addition, the transfer means may be composed of one rotary table loading the full packages having all kinds of threads, instead of a plurality of belt conveyers provided per kind of thread, for example.

In more details, a horizontal disc-like table is provided rotatably around a central axis thereof, and the full packages having a plurality of kinds of threads are arranged along one line in their circumferential directions in a certain sequence based on the kinds of threads. As for a certain sequence, for example, the circumference of the table is equally divided into three parts, and the full packages with three colors are disposed at each circular arc, or a full package each with a different color is disposed one by one alternately. As for the table, it is controlled to rotate so that the full package having a kind of thread required by a weaving machine may be disposed at one point on the circumference. A control unit for driving the table to rotate judges the correspondence between a rotational position and a kind of thread on the basis of a certain sequence described above. The full package transferred to one point on the circumference is disposed at the loading location by other arrangement devices. In addition, if one point on the circumference is made to correspond to the loading location, other arrangement devices are not needed.

As described above, one of a plurality of full packages 14 is selectively disposed in the neighborhood of one point a in the supply region 16 on the travel path 24 of the carriers 22, whereby the full package having a suitable kind of thread to the requirements of the weaving machine is prepared at one loading location 25.

Figure 14:
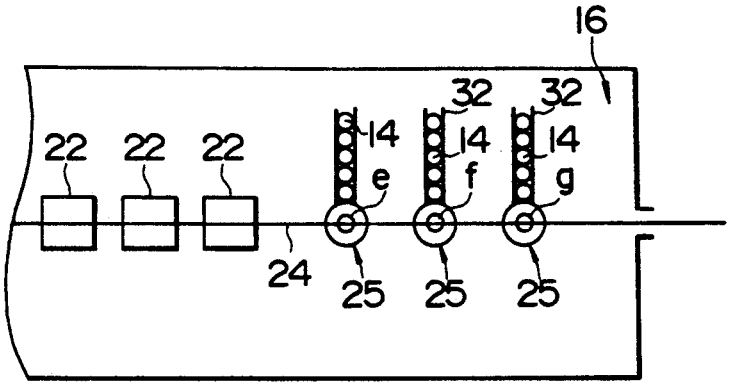
FIG. 14 is an enlarged-scale schematic view showing a supply region of full packages in a weaving factory according to another embodiment.

On the other hand, in an embodiment shown in FIG. 14, the full packages 14 having a plurality of kinds of threads are disposed in the neighborhood of a plurality of points e, f and g (three points in the illustrated embodiment) in the supply region 16 on the travel path 24 of the carriers, that is, at three loading locations 25 at the lower position in the illustrated embodiment.

In this weaving factory having three loading locations, the carriers 22 are stopped at a position above the loading locations 25 where the full package 14 agrees with the kind of threads required by the weaving machine, that is, at one location of the abovementioned plurality of points e, f and g, where the supply of the required full packages 14 is performed.

In addition, the transfer means may be composed of the above-mentioned rotational table. At this time, the travel path 24 is formed along the outer periphery of the rotational table, and three loading locations are provided in the neighborhood of a plurality of points on the travel path 24. The rotational table is controlled to rotate so as to place the full packages having the required kinds of threads at three points on the circumference, which are set in accordance with three loading locations.

Figure 15:
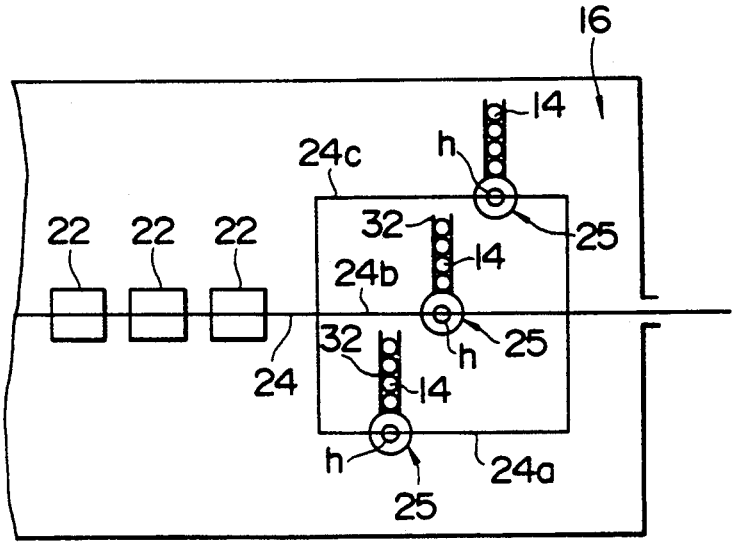
FIG. 15 is an enlarged-scale schematic view showing a supply region of full packages in a weaving factory according to a further embodiment.

Alos, in the embodiment shown in FIG. 15, the travel path 24 is composed of a plurality of bypasses 24*a*, 24*b* and 24*c* (three paths in the illustrated embodiment) in the supply region 16. The full packages having the different kinds of threads are arranged and prepared in the neighborhood of one point h on each bypass, that is, at the lower loading locations 25 in the illustrated embodiment.

According to this embodiment, the carriers 22 are guided above the loading locations 25 where are disposed the full packages 14 matching the required kinds of threads by the weaving machine 11, that is, to either 32 one of the bypasses and stopped at one point h on the bypass, where a supply of the required full packages 14 is performed.

Figure 2:
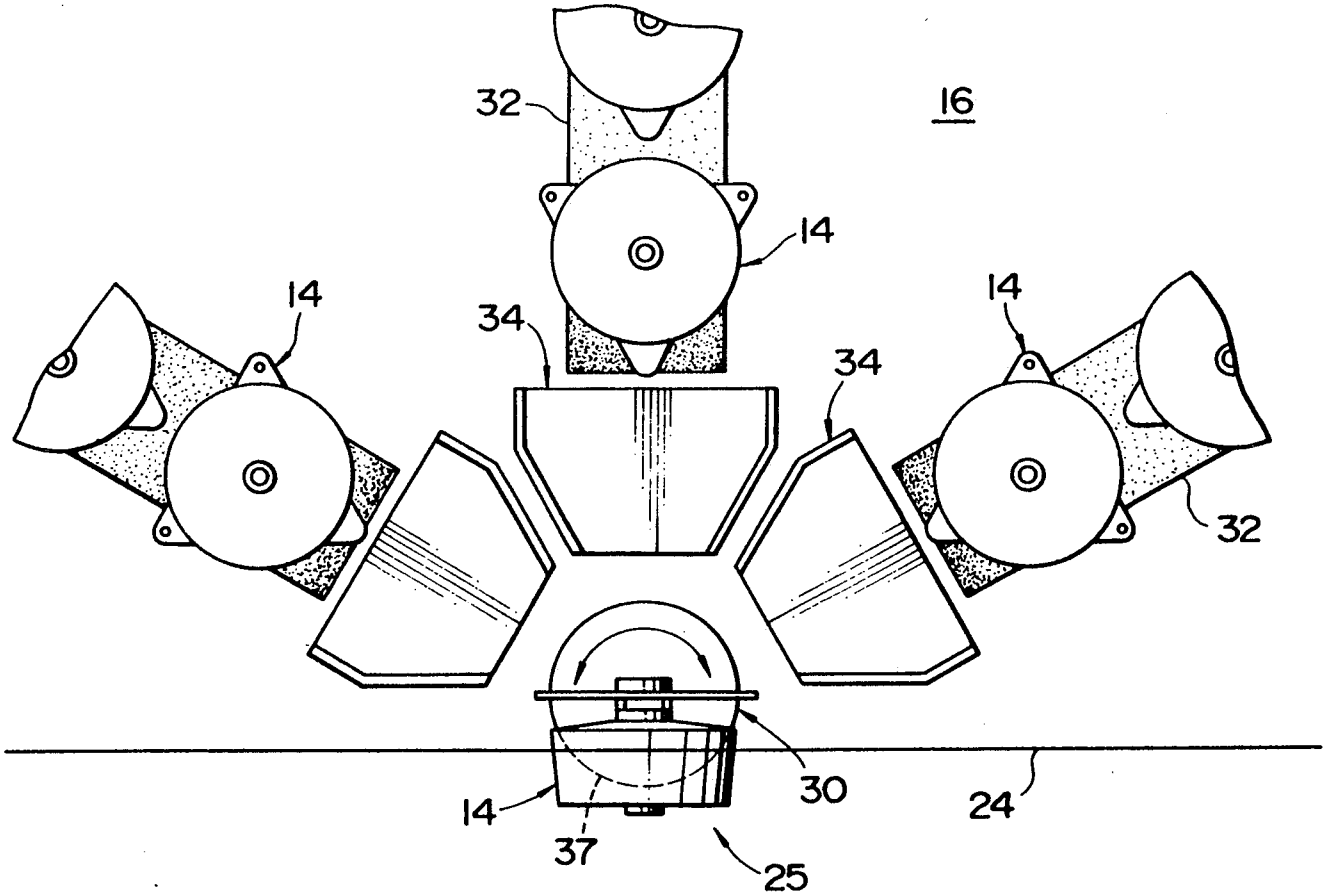
FIG. 2 is a partial schematic plan view showing a device according to the present invention.

In the embodiments shown in FIGS. 14 and 15, the arrangement device is disposed with respect to each loading location. That is, the delivery means similar to the delivery means 30 shown in FIG. 2 is disposed at each loading location 25, and a pair of transfer means and guide means 34 which are similar to the transfer means 2 and the guide means 34 shown in FIG. 2 are also disposed in the neighborhood of each loading location.

The arrangement device can be composed of only belt conveyers capable of carrying the full package up to the loading location or by only such transfer means as an oscillating arm (not shown) capable of holding the feed body, instead of the illustrated embodiments in which the arrangement devices are composed of the delivery means, the transfer means and the guide means.

Moreover, the full packages 14 are preliminarily loaded on each carrier 22, and then, the carrier 22 is kept waiting. When any demand of the feed body exchange from the weaving machine is available, the carrier 22 may be moved to the weaving machine 11 to do the exchange operation of the weft packages 14,18.

According to this structure, the time for loading the full packages 14 on the carrier 22 can be saved, so that there is such an advantage as the carrier 22 can reach the neighborhood of the weaving machine more swiftly.

In addition, after the exchange operation is over, the carrier 22 delivers the empty package 18 in the accommodation region 20, and receives the full package 14 having the same kind of thread as previously supplied full package at the loading location 25 and then, keeps waiting again.

For example, to explain concretely using FIG. 15, one of the full packages 14 having a different kind of threads is loaded on each of a plurality of carriers 22 to stand by at each bypass 24*a*, 24*b* or 24*c* on the downstream side of the loading location 25.

Furthermore, to explain another constitution using FIG. 1, three full packages 14 each having a different kind of thread are loaded on each carrier 22 to stand by in series on the rail 24 between the loading location 25 and the outlet of the supply region 16. When any demands from the weaving machine 11 are available, the lead carrier 22 is moved and the full package 14 having a required kind of thread is selectively supplied from the full packages 14 to be loaded on the carrier 22. After supplying such full package 14, the empty package 18 is accommodated in the supply region 16, and then, the full package 14 having the same kind of thread as the supplied full package 14 is supplied at the loading location, where it is kept waiting again.

Figure 16:
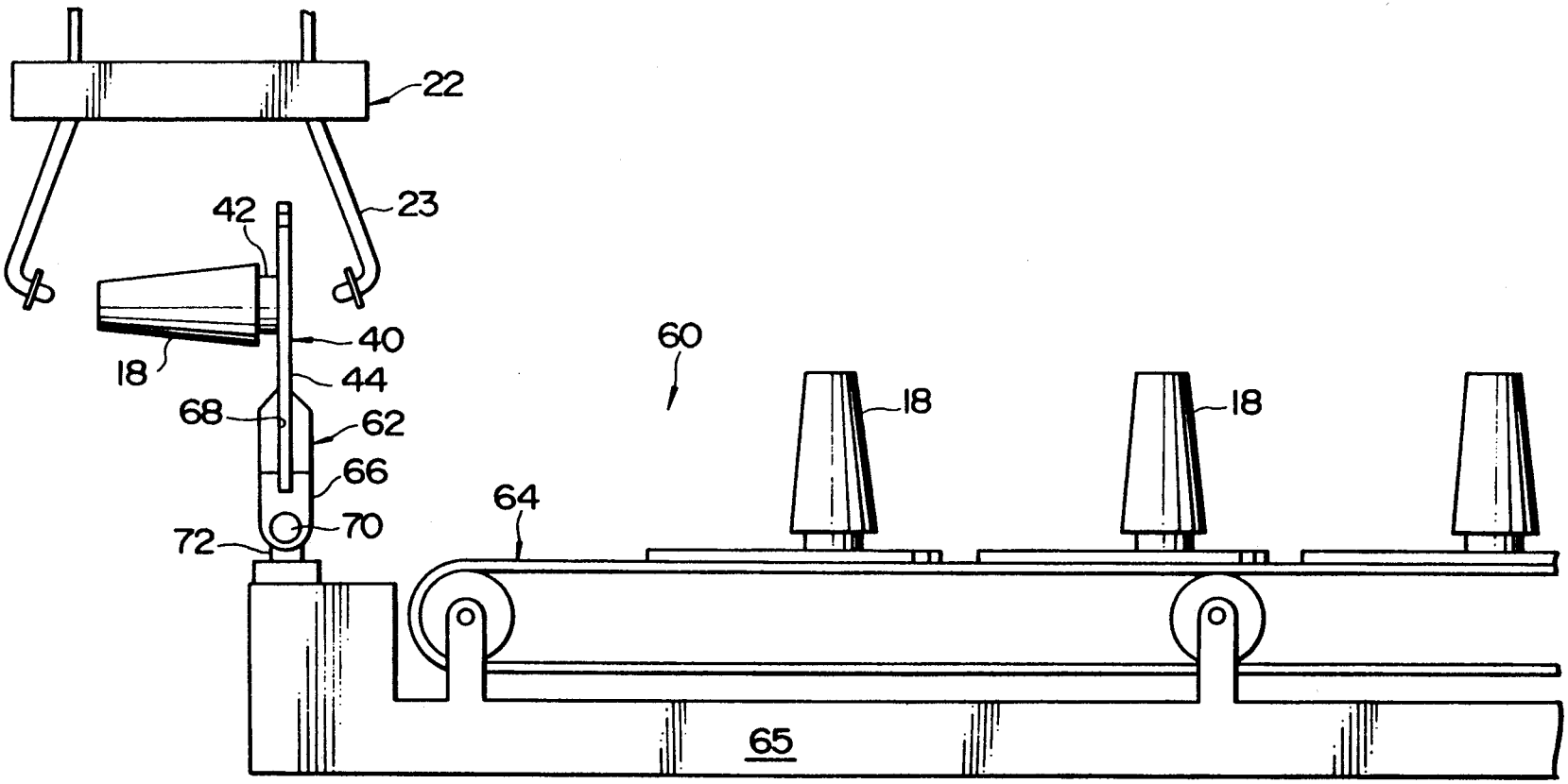
FIG. 16 is a partial enlarged-scale side view showing an accommodation device when a portion of the delivery means is in its perpendicular condition.
Figure 17:
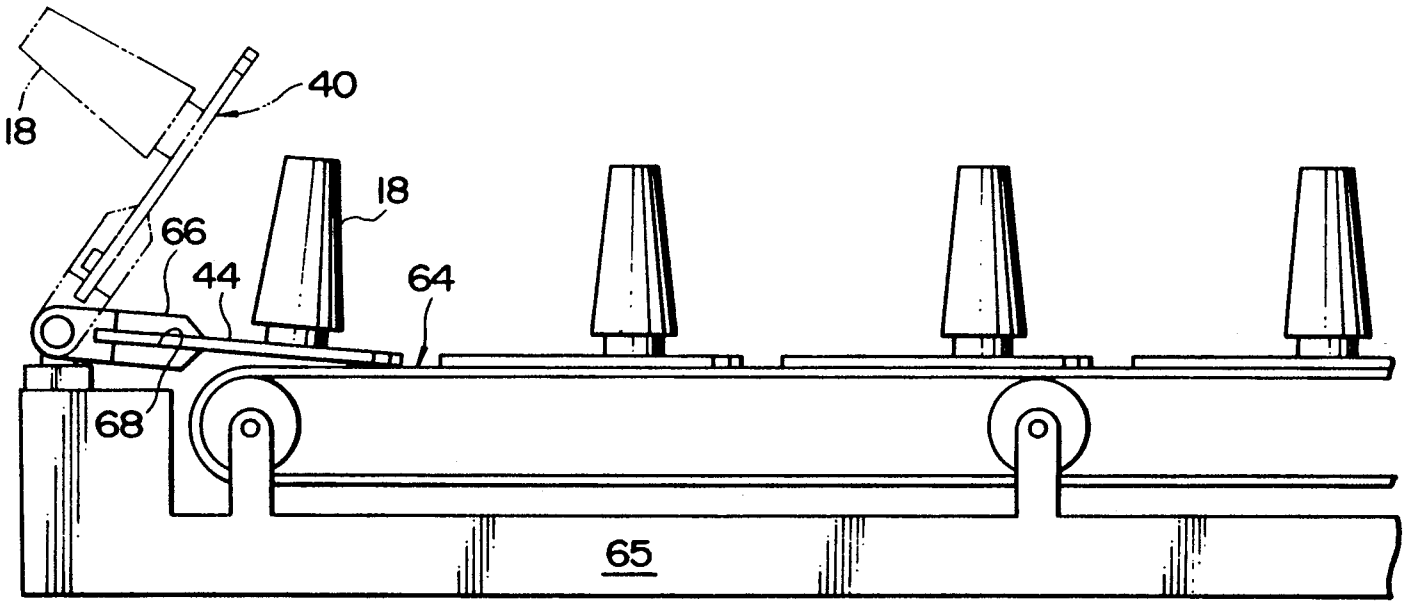
FIG. 17 is a partial enlarged-scale side view showing the accommodation device when a portion of the delivery means is in its inclined condition.

Referring now to FIGS. 16 and 17, an accommodation device 60 of empty package 18 disposed in the accommodation region 20 is illustrated.

The accommodation device 60 includes delivery means 62 disposed in the neighborhood of one point in the accommodation region on the travel path 24 of the carriers 22 for carrying the empty packages 18 recovered from the weaving machines 11 and a plurality of transfer means 64 (three in the illustrated embodiment) for carrying the empty packages 18 from the delivery means 62 per kind of thread.

In the illustrated embodiment, the delivery means 62 is installed in a machine base 65 used with the transfer means 64 in common at an interval from the transfer means 64 composed of belt conveyers. The delivery means 62 includes a holding plate 66 similar to the aforementioned holding plate 39, and the holding plate 66 has a concave portion 68 similar to the aforementioned concave portion 46 capable of accepting part of the plate portion 44 of the tray 40. The illustrated concave portion 68 is, however, opened in three directions.

The holding plate 66 is rotatably supported at approximately 90° toward the transfer means 64 from its perpendicular state around a horizontal axis 70 which is at approximately same level as the carrying plane of the transfer means 64, and it is supported on the machine base rotatably around a vertical axis 72.

The holding plate 66 in its perpendicular condition which has received the empty package 18 from the carrier 22 is rotated around the horizontal axis 70 until the top end of the plate portion 44 of the tray protruding from the holding plate 66 is placed on the conveyer belt defining the carrying plane of the transfer means 64. The tray 40 holding the empty package 18 is slipped out of the concave portion 68 of the holding plate 66 due to the frictional force between the top end of the plate portion 44 and the conveyer belt, and then, the resulting empty package 18 is transferred to a predetermined location by the transfer means 64.

Three transfer means 64 are disposed angularly around the delivery means 62 spaced from one another and extend in their radial directions in similar to the embodiments shown in FIGS. 2 through 5. The empty packages 18 received by the delivery means 62 can be delivered to each transfer means 64 in accordance with the kinds of threads by rotating the delivery means 62 around the horizontal axis 72. Namely, the empty packages 18 can be distributed into each kind of thread. Thus, such distribution of the empty packages can be done only by stopping the carrier 22 at one location of the travel path 24.

Guide means similar to the guide means shown in FIGS. 2 through 13 can be disposed between the delivery means 62 and each transfer means 64. However, the inclined face of the guide means extends from the delivery means 62 downwards in the direction of each transfer means 64. It is desirable that the inclined face end at the upper portion of the carrying plane of the transfer means. Moreover, the inclined face inclines at the same angle as the holding plate 66 in its inclined condition.

In case the bobbins for the full packages having the different kinds of threads are of the same shape, there is no need of the distribution, that is, classifying the bobbins, and therefore, it is sufficient to dispose either one transfer means 64 or one transfer means and one guide means may be arranged.

To know beforehand the kinds of threads of the required full packages 14 at the time of supplying full packages 14 are supplied to the weaving machine 11 or those to which the recovered empty packages 18 belong, for example, as shown in FIG. 18, the symbols given to the kind of thread of the full package provided in each weft package stand in accordance with the machine base number of the weaving machine 11 and the numbers of the weft package stands 26 and 28 are stored in the control unit for the supply device of the full package, for example, symbols such as 1-1 and 4-2 from the weaving machine can be input as a command signal.

Some combinations of other symbols are shown in FIG. 19. In this combination, the kinds of the required full packages 14 and the recovered empty packages 18 can be discriminated by inputting the signals, e.g., 1, 9, as serial numbers throughout all weft package stands from the weaving machine.

Furthermore, a plurality of weaving machines 11 employ the full packages each having a single kind of thread, and in case the kinds of full packages handled in a plurality of weaving machines are plural, the kinds of full packages required by the weaving machines 11 can be discriminated by inputting only the machine base number of the corresponding weaving machine 11.

Finally, the lower position of the above-mentioned one point is illustrated as the neighborhood of one point on the travel path 24. In case the rail 24 is installed on the floor, the neighborhood of one point on the travel path is, for example, the side position of the travel path.

What is claimed is:

1. A mechanism for transferring full weft packages at a loading location to a carrier carrying the full packages from a supply region to an installation region of weaving machines, comprising: a plurality of transfer means for transferring groups of full weft packages with different kinds of threads, each group having the same kind of thread, within said supply region; delivery means disposed in said loading location for delivering said full weft packages; and guide means for receiving full weft packages from respective transfer means and delivering full weft packages to said delivery means, wherein each full weft package is held on a tray; said guide means having an inclined face and a pair of guide walls standing up from said inclined face, with part of the full weft package tray projecting below said guide means and toward said delivery means; and wherein said delivery means has a holding plate capable of being selectively positionable in a vertical position or an inclined position in alignment with and below the inclined face of said guide means, said holding plate having a concave portion for accepting said part of the tray projecting below said guide means so as to hold said full weft package in said inclined state.

2. A mechanism according to claim 1, wherein said tray is provided with a plate portion having a triangular planar shape capable of contacting the inclined face and both guide wall of said guide means, and wherein both guide walls of said guide means extend along two sides of a triangular shape.

* * * * *